US009102491B2

(12) United States Patent
Rodriguez

(10) Patent No.: US 9,102,491 B2
(45) Date of Patent: Aug. 11, 2015

(54) TURN-UP TAPE DELIVERY ASSEMBLY COMPRISING A DUAL CHANNEL TRACK FOR PAPER WEB TURN-UP SYSTEMS

(71) Applicant: Peter A. Rodriguez, Atlantic Beach, FL (US)

(72) Inventor: Peter A. Rodriguez, Atlantic Beach, FL (US)

(73) Assignee: SANBAR INDUSTRIES, INC., Atlantic Beach, FL (US)

( * ) Notice: Subject to any disclaimer, the term of this patent is extended or adjusted under 35 U.S.C. 154(b) by 221 days.

(21) Appl. No.: 13/947,325

(22) Filed: Jul. 22, 2013

(65) Prior Publication Data

US 2014/0021285 A1 Jan. 23, 2014

Related U.S. Application Data

(60) Provisional application No. 61/674,002, filed on Jul. 20, 2012.

(51) Int. Cl.
*B65H 19/26* (2006.01)
*B65H 19/28* (2006.01)

(52) U.S. Cl.
CPC ..... *B65H 19/262* (2013.01); *B65H 19/283* (2013.01)

(58) Field of Classification Search
CPC ..... B65H 19/26; B65H 19/262
USPC ..... 242/526.2; 83/542
See application file for complete search history.

(56) References Cited

U.S. PATENT DOCUMENTS

| | | | | | |
|---|---|---|---|---|---|
| 4,265,176 | A | * | 5/1981 | Sato | 101/292 |
| 4,659,029 | A | | 4/1987 | Rodriguez | |
| 4,711,404 | A | | 12/1987 | Falk | |
| 4,757,950 | A | | 7/1988 | Rodriguez | |
| 4,783,018 | A | | 11/1988 | Rodriguez | |
| 4,964,584 | A | | 10/1990 | Taipale et al. | |
| 5,046,675 | A | | 9/1991 | Rodriguez | |
| 5,467,937 | A | * | 11/1995 | Rodriquez et al. | 242/526.2 |
| 5,573,626 | A | | 11/1996 | Rosseni et al. | |
| 5,725,177 | A | | 3/1998 | Bartelmuss et al. | |
| 5,954,290 | A | | 9/1999 | Rodriguez et al. | |
| 6,013,148 | A | | 1/2000 | Bluemie | |
| 6,305,634 | B1 | | 10/2001 | Rodriguez | |
| 6,416,012 | B1 | | 7/2002 | Wilmoth et al. | |
| 6,575,395 | B2 | | 6/2003 | Rodriguez | |
| 7,290,732 | B2 | | 11/2007 | Wilmoth et al. | |
| 7,875,152 | B2 | | 1/2011 | Rodriguez | |

OTHER PUBLICATIONS

PCT Notification of Transmittal of the International Search Report and the Written Opinion of the International Searching Authority, or the Declaration, mail date Feb. 7, 2014, PCT/US2013/51464.

* cited by examiner

*Primary Examiner* — Sang Kim
(74) *Attorney, Agent, or Firm* — Thomas C. Saitta

(57) ABSTRACT

An improved tape delivery assembly for delivering a turn-up tape across a moving web of paper being wound onto a spool, the assembly being part of a paper web turn-up system, the tape being used to sever and transfer the leading edge of the cut paper web onto an empty spool. The track body of the tape delivery assembly extending across the paper web comprises a dual internal pathway, having a primary longitudinal channel and a secondary longitudinal channel through which a primary or secondary tape is passed, respectively. A primary tape dispenser assembly delivers the primary tape into the primary channel and a secondary tape dispenser assembly delivers the secondary tape into the secondary channel. A braking mechanism is provided to retard travel of the primary and secondary tapes for removal from the track body.

20 Claims, 4 Drawing Sheets

TURN-UP TAPE DELIVERY ASSEMBLY COMPRISING A DUAL CHANNEL TRACK FOR PAPER WEB TURN-UP SYSTEMS

This application claims the benefit of U.S. Provisional Patent Application Ser. No. 61/674,002, filed Jul. 20, 2012, the disclosure of which is incorporated herein by reference.

BACKGROUND OF THE INVENTION

The present invention relates to track or guideway assemblies for a turn-up or cutting tape used in turn-up and transfer operations in the papermaking industry, and particularly to any such systems wherein a back-up or secondary turn-up tape can be delivered into the track assembly in the event there is a misfeed or other malfunction in the delivery of the primary tape.

Modern paper manufacture is typically performed by producing continuous elongated webs of paper, having widths of up to 330 inches in some cases, which are wound onto spools for subsequent processing, storage, transfer or the like. The spooling operation for the paper web occurs at high speeds, in some cases as high as 8000 feet per minute, and in order to maximize production by minimizing downtime, when a spool becomes full it is desirable to immediately sever the paper web and transfer the newly formed free edge of the web onto an empty spool without stopping or slowing movement of the web. To accomplish this it is well known to utilize a turn-up tape, usually having a pressure-sensitive adhesive applied to one side, that is fed through a slotted track or guideway assembly that extends across the paper web. When severing is desired, the turn-up tape is extended from the discharge of the track into a nip roller or similar mechanism for grabbing the end of the turn-up tape, which is then pulled from the track slot and drawn tightly across the web, thereby severing the paper web and securing the free edge onto the empty spool.

Turn-up tape delivery assemblies for delivering, guiding and actuating turn-up or severing tapes, typically made of paperband, in continuous paper web turn-up systems are well known. Examples of such systems are shown for example in U.S. Pat. Nos. 4,659,029, 4,757,950, 4,783,018, 5,046,675, 5,954,290, 6,305,634, 6,575,395 and 7,875,152, all to Rodriguez, as well as U.S. Pat. No. 4,711,404 to Falk, U.S. Pat. No. 4,964,584 to Taipale et al., U.S. Pat. No. 5,725,177 to Bartelmuss et al., U.S. Pat. No. 6,416,012 to Wilmoth et al., and U.S. Pat. No. 7,290,732 to Wilmoth et al., the disclosures of which are incorporated herein by reference. Typical traversing track assemblies extending across the paper web have a T-shaped open channel through which the tape is delivered transversely across the paper web. A braking mechanism is provided in order to frictionally engage the tape in order to cause it to be drawn out of the track slot and onto the paper web after the tape has been secured to the new spool or axle. The channel typically terminates with a curved transitional section having a particular configuration for directing the end of the cutting tape so as to attach to the spool, often to the axle of the spool, utilizing various known mechanisms or methods, such that the combination of this attachment and the braking by the braking mechanism causes the tape to be longitudinally folded and drawn from the slotted track, thereby cutting the web and pulling the new leading edge onto the empty spool.

It is not uncommon to encounter situations where there is a misfeed or other failure in the delivery assembly or mechanism for the turn-up tape, which necessitates halting the system to provide a secondary or replacement tape, which results in lost production time. It is an object of this invention to provide a system wherein a secondary or auxiliary paperband-type turn-up tape can be immediately delivered to the spool in place of the malfunctioning primary tape or paperband, the tape delivery assembly or system comprising a guideway track body having parallel dual paperband pathways capable of delivering either a primary and a secondary tape as required. It is an object of this invention to provide such a system having different embodiments wherein the secondary tape may be fed manually or by a powered delivery mechanism, wherein the secondary tape may be initiated manually or automatically in response to the malfunction of the primary tape, and wherein the system may be provided with a release liner removal mechanism to automatically remove a release liner from the secondary tape as it is advanced through the guide track assembly. These and other objects not explicitly expressed above will be apparent from the disclosure to follow.

SUMMARY OF THE INVENTION

The present invention relates to an improved turn-up tape delivery assembly for feeding and guiding a transfer or cutting turn-up tape through a traversing guideway or track assembly wherein the turn-up tape is positioned transversely across a moving web of paper being wound onto a spool. The tape delivery assembly comprises a traversing track body comprising dual internal channels or pathways, the track body having a primary longitudinal channel through which a primary tape is delivered and a secondary longitudinal channel through which a secondary paperband is delivered. A longitudinal slot is provided that allows the tapes to be drawn from the channels. Preferably, the combination of the dual channels and slot forms a doubled-headed T-shape, with the leg of the "T" extending through the wall of the track body. A primary dispenser assembly delivers the primary paperband into the primary pathway and a secondary dispenser delivers the secondary paperband into the secondary pathway. The primary and secondary pathways are preferably in parallel within the track body. The secondary dispenser may be manual or powered, and initiation of delivery of the secondary tape may be automated in response to sensor input. A brake mechanism is incorporated in the track body that is adapted to be able to brake either the primary or the secondary tape, and different embodiments for the brake mechanism are disclosed as required to account for the presence of two tapes within the brake mechanism.

In alternative format, the invention is a paper web turn-up system turn-up tape delivery assembly adapted to deliver a primary tape and a secondary tape across a paper web utilized to sever a paper web and transfer the paper web onto an empty spool, the turn-up tape delivery assembly comprising a track body; said track body comprising a primary channel adapted to receive a primary tape, a secondary channel adapted to receive a secondary tape, an elongated slot in communication with said primary channel and said secondary channel, and a discharge end; wherein both said primary channel and said secondary channel are adapted to communicate with said discharge end of said track body such that the primary tape and the secondary tape are deliverable through said discharge end; a primary tape delivery assembly adapted to deliver the primary tape into said primary channel of said track body; a secondary tape delivery assembly adapted to deliver the secondary tape into said secondary channel of said track body; wherein in the event of a misfeed of the primary tape through said primary channel of said track or a malfunction of the primary tape delivery system, the secondary tape is delivered by said secondary tape delivery system through said secondary channel and said discharge end of said track body. In additional embodiments, such an assembly wherein said primary channel and said secondary channel are disposed in parallel within said track body, and possibly further comprising a braking mechanism operable in conjunction with said primary channel and said secondary channel to retard both the primary tape and the secondary tape, whereby upon activation of said braking mechanism said primary tape or said secondary tape is pulled through said slot of said track body.

The braking assembly may comprise a primary brake foot member operated by a primary actuating mechanism, said primary brake foot member positioned to contact the primary tape within said primary channel; a secondary brake foot member operated by a secondary actuating mechanism, said secondary brake foot member positioned to contact the secondary tape within said secondary channel; and a fixed brake pad member disposed between said primary channel and said secondary channel; whereby actuation of said primary actuating mechanism forces the primary tape against said fixed brake pad member, thereby retarding travel of the primary tape, and whereby actuation of said secondary actuating mechanism forces the secondary tape against said fixed brake pad member, thereby retarding travel of the secondary tape; or alternatively may comprise a brake foot member operated by a brake actuating mechanism, said brake foot member positioned to contact either the primary tape or the secondary tape; a movable brake pad member disposed between said primary channel and said secondary channel, and disposed between the primary tape and the secondary tape; whereby actuation of said brake actuating mechanism forces either the primary tape or the secondary tape against said movable brake pad member, forces said movable brake pad member against the other of the primary tape or secondary tape, and forces said other of the primary tape or secondary tape against a wall of either said primary channel or said secondary channel, thereby arresting travel of both the primary tape and the secondary tape.

In additional embodiments, the assembly may comprise a liner retarding member disposed within said secondary channel; whereby in conjunction with a secondary tape having a release liner, said liner retarding member removes the release liner from the secondary tape as the secondary tape is advanced past said liner retarding member, and may further comprise an ejection window disposed on said track body; whereby in conjunction with a secondary tape having a release liner, said liner retarding member removes the release liner from the secondary tape as the secondary tape is advanced past said liner retarding member, such that the release liner when removed is ejected through said ejection window.

DETAILED DESCRIPTION OF THE INVENTION

The invention will now be described with reference to the drawings and various embodiments. In general, the invention is a turn-up tape delivery assembly or system that is adapted and structured to position a turn-up tape laterally across a paper web being fed onto a first spool in order to sever and transfer the paper web onto an empty spool, the turn-up tape being pulled in various known manner from the transverse portion of the track body extending across the web so as to sever the web and attach the newly formed free edge onto the empty spool. The term "turn-up tape" or "tape" as used herein shall be taken to define and include any such tape as known in the industry which may for example be referred to as a transfer tape, a severing tape, a cutting tape, a paperband or the like.

Figure 1:
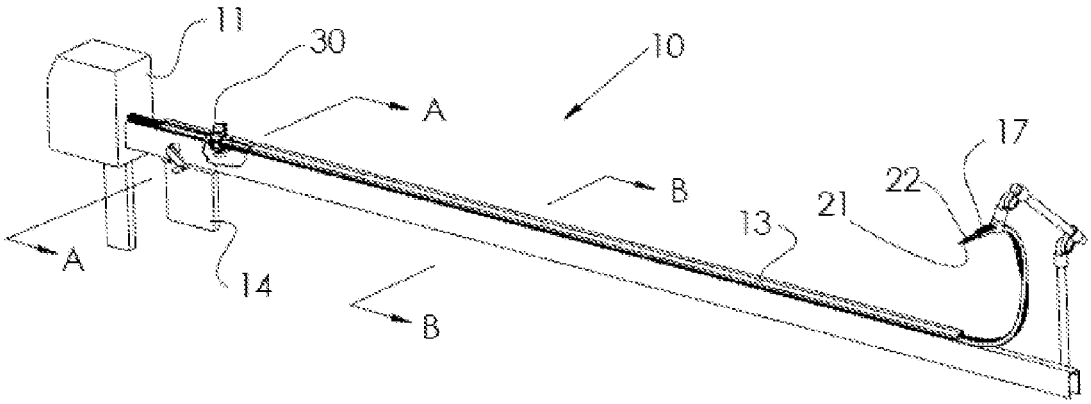
FIG. 1 is an illustration of an embodiment of the dual pathway turn-up tape delivery assembly.

As shown in FIG. 1, a representative embodiment of the turn-up tape delivery assembly 10 comprises a primary tape dispenser assembly or mechanism 11 of known type and operation, such as for example a loopless dispenser of the type known in the industry, for retaining and delivering a primary turn-up tape 21 into and through a slotted, traversing track body 13. In use a portion of the track body 13 is positioned to extend laterally or transversely across the paper web that is being loaded onto a spool. In normal operation, the primary tape 21 and the primary tape dispenser assembly 11 are utilized to perform the web severing and transfer operation. The primary tape 21 is delivered through a primary channel 12 within the track body 13 of the tape delivery assembly 10, through a braking assembly or mechanism 30, and into and through the slotted portion of the track body 13. Severing of the paper web is accomplished by extending the end of the primary tape 21 from the discharge end 17 of the track body 13 into a nip roller or equivalent mechanism for securing the primary tape to the empty spool or its axle. At this time activation of the braking mechanism 30 temporarily retards the primary tape 21, resulting in the primary tape 21 being withdrawn through the slot 18 in the traversing track body 13 and onto the paper web, thereby severing the web and transferring its newly created free edge onto the new spool. The primary tape dispenser assembly 11 is usually a powered mechanism that is actuated automatically to deliver the primary tape 21 as required. Preferably a flexible cover member 23 is disposed along the track body 13 to cover the channels 12 and 15 and slot 18 to prevent debris from accumulating in the channels 12 and 15 and slot 18 so as not to fowl the adhesive layer present on the tapes 21 and 22.

A secondary tape dispenser assembly 14 is connected, associated with or mounted to the track body 13 of the tape delivery assembly 10 and is adapted to retain and deliver an auxiliary or secondary turn-up tape 22 into a secondary channel 15 disposed within the track body 13. Suitable dispenser assemblies 14 are known in the industry. As with the primary tape 21, the secondary tape 22 passes through the braking mechanism 30. The secondary tape dispenser assembly 14 may be a manually operated or powered dispenser, and preferably is a powered dispenser that is actuated automatically in response to a malfunction of the primary tape dispenser assembly 11 or a misfeed of the primary tape 21 as sensed by sensors of known type incorporated into the tape delivery assembly 10. The secondary channel 15 preferably extends fully to the discharge end 17 of the traversing track body 13, but alternatively the secondary channel 15 may be merged with the primary channel 12 at a point prior to the discharge end 17 of the traversing track body 13.

Figure 4:
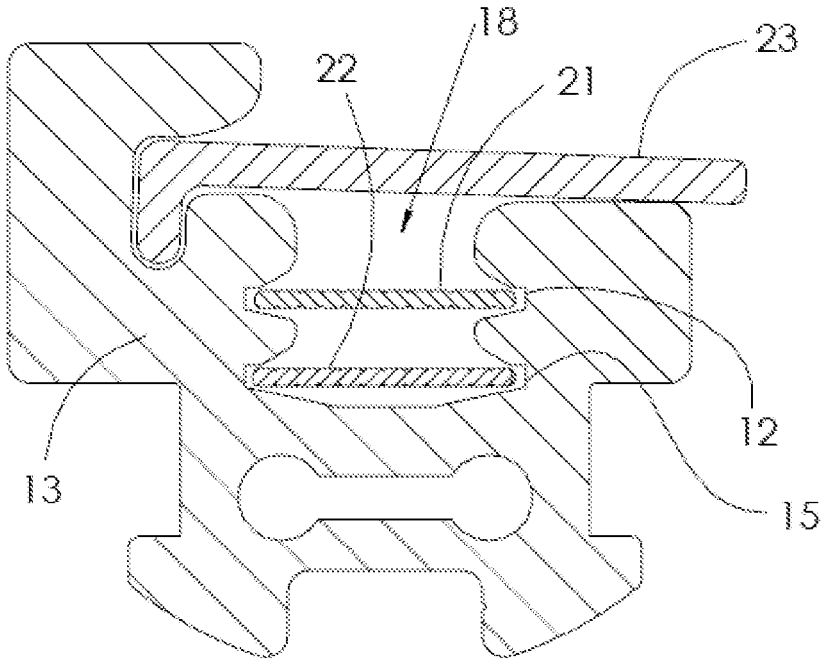
FIG. 4 is a cross-sectional view of the main track body taken along line B-B of FIG. 1.
Figure 5:
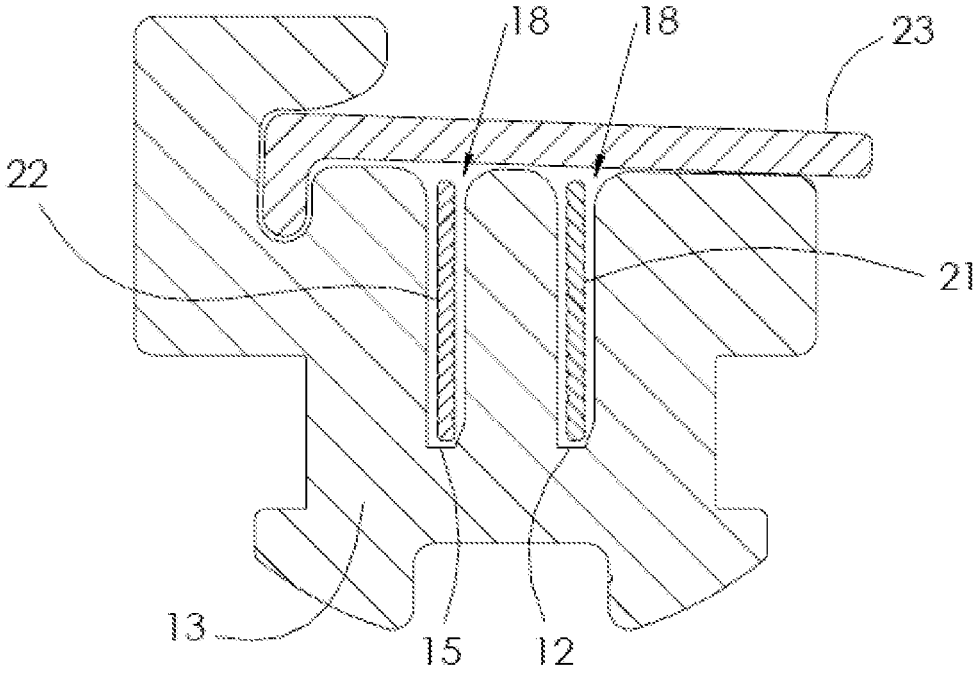
FIG. 5 is a cross-sectional view of an alternative embodiment of the main track body similar to FIG. 4.
Figure 6:
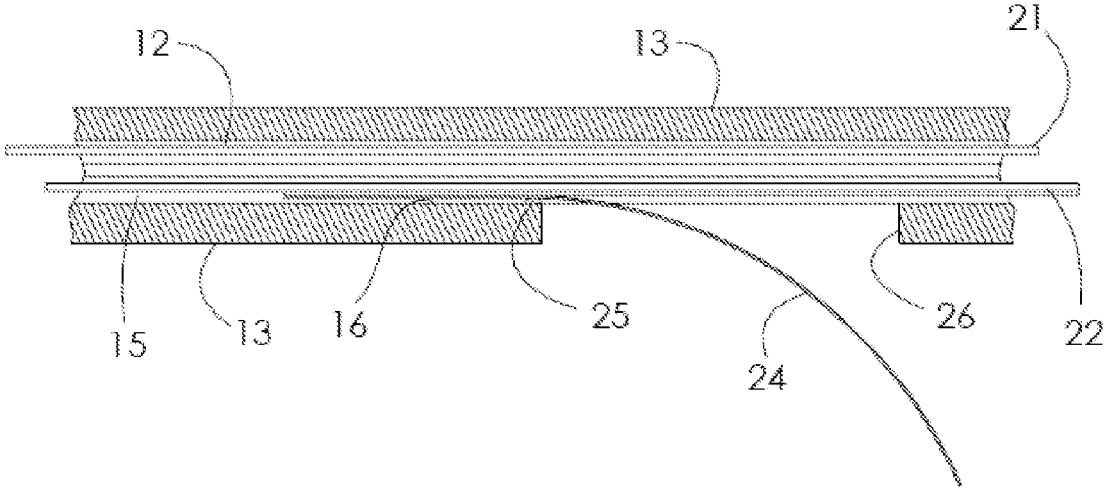
FIG. 6 is a partial cross-sectional, partially exposed view showing the liner retarding member and the ejection window in the main track body.

In order to conserve space within the overall system, the primary channel 12 and the secondary channel 15 are disposed within a single track body 13. Most preferably, although not essentially, the primary channel 12 and the secondary channel 15 are disposed in parallel within the main track body 13, preferably in open communication as shown for example in FIG. 4, such that the elongated slot 18 communicates with both channels 12 and 15 such that either the primary tape 21 or the secondary tape 22 may be drawn through slot 18 as necessary, the slot 18 being oriented generally perpendicularly to the channels 12 and 15. The track body 13 comprises both channels 12 and 15 such that only a single mounting and support system is required to utilize the tape delivery assembly 10. An alternative embodiment for the main track body 13 is shown in FIG. 5. In this embodiment, the parallel channels 12 and 15 within the main track body 13 are vertically oriented, and the longitudinal edges of channels 12 and 15 themselves define a pair of slots 18 in this orientation. Orientations between horizontal and vertical are also possible. The dual channel nature of the traversing track body 13 enables it to be manufactured as a single extrusion, or as a split extrusion subsequently joined together which may be utilized to allow for adjustment of the width of the channels 12 and 15.

Figure 2:
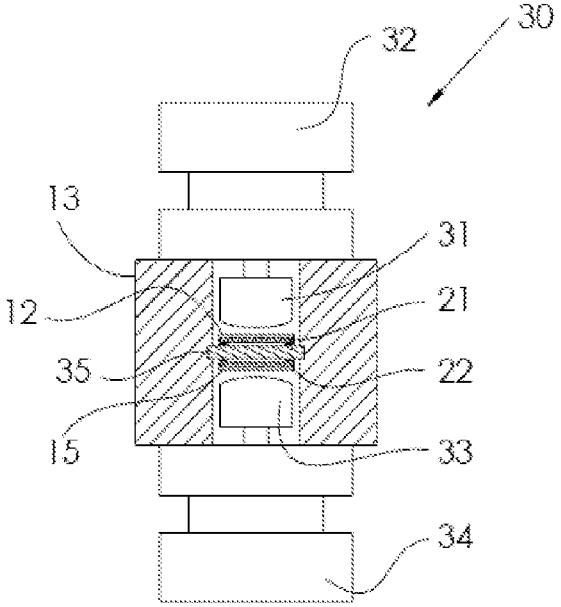
FIG. 2 is a cross-sectional, partially exposed view of a first embodiment of the brake assembly taken along line A-A of FIG. 1.

The braking mechanism 30 must be capable of braking either the primary tape 21 or the secondary tape 22 as required. As shown in FIG. 2, a first embodiment for the braking mechanism 30 comprises a primary brake foot member 31 operated by a primary pneumatic cylinder or similar actuating mechanism 32 extending into the primary channel 12 and a secondary brake foot member 33 operated by a secondary pneumatic cylinder or similar actuating mechanism 33 extending into the secondary channel 15. The combination of the primary brake foot member 31 and primary pneumatic cylinder 32 and the combination of the secondary brake foot member 33 and secondary pneumatic cylinder 34 are disposed on opposite sides of the main track body 13. A fixed brake pad member 35 is disposed between the primary tape 21 and the secondary tape 22 between the channels 12 and 15. During normal operation, the primary brake pneumatic cylinder 32 is activated to advance the primary brake foot member 31 to press the primary tape 21 against the brake pad member 35 in order to temporarily retard or restrain the primary tape 21 so that it is drawn through slot 18 to sever and transfer the paper web. In the event of a misfeed or other malfunction such that the primary tape 21 is not properly disposed, the secondary brake pneumatic cylinder 34 is activated to advance the secondary brake foot member 33 to press the secondary tape 22 against the brake pad member 35 in order to retard the secondary tape 22 to sever and transfer the paper web.

Figure 3:
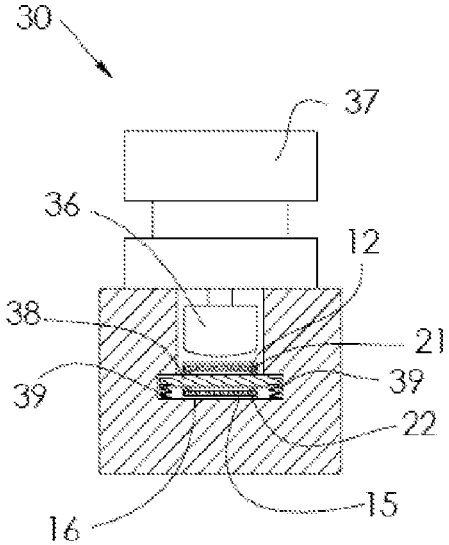
FIG. 3 is a cross-sectional, partially exposed view of a second embodiment of the brake assembly similar to FIG. 2.

An alternative embodiment for the braking assembly 30 is shown in FIG. 3. In this embodiment a single brake foot 36 and pneumatic cylinder or other brake actuating mechanism 37 is utilized in conjunction with a movable or floating brake pad member 38 that is suspended between the primary tape 21 and primary channel 12 and the secondary tape 22 and secondary channel 15, the floating brake pad 38 being retained in position for example by resilient mounting members 39, such as for example spring members. In this embodiment, when either the primary tape 21 or the secondary tape 22 is to be temporarily secured, the pneumatic cylinder 37 advances the brake foot member 36 into the primary channel 12 and against the primary tape 21, forcing the primary tape 21 against the brake pad member 38, in turn forcing the brake pad member 38 into the secondary channel 15 against the secondary tape 22 and the secondary tape 22 against the interior wall 16 of the secondary channel 15. Alternatively, the brake assembly 30 could be disposed on the secondary side of the main track body 13, with the above described operation being reversed.

Figure 7:
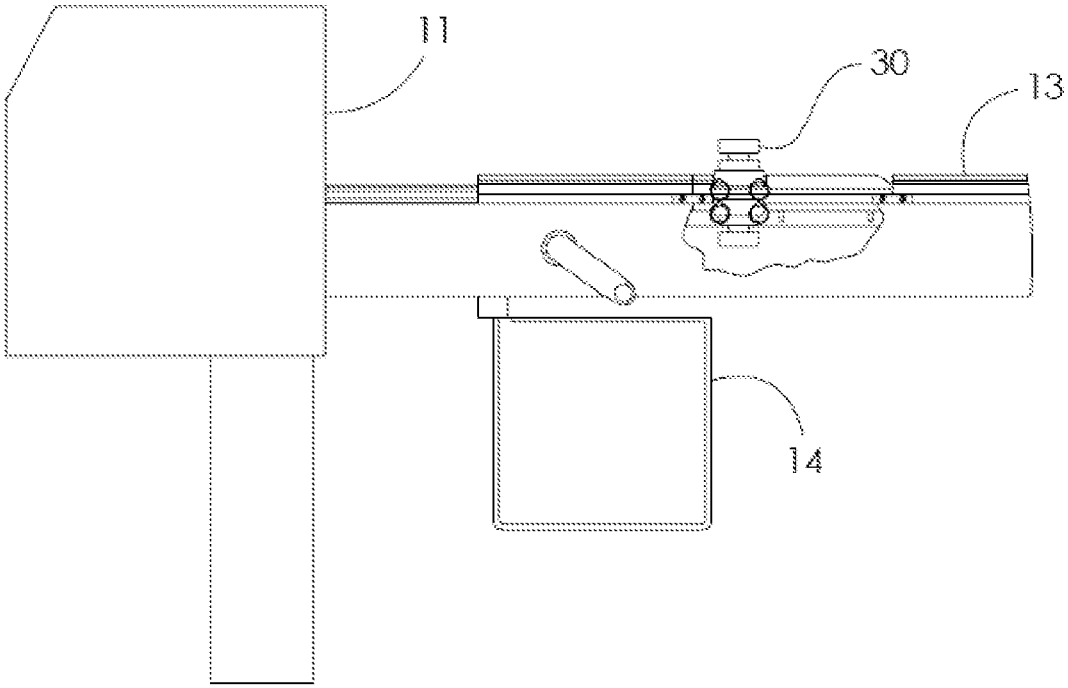
FIG. 7 is a partial view, partially exposed, of the tape delivery assembly of claim 1 showing the primary and secondary tape delivery assemblies and an embodiment of the braking mechanism.
Figure 8:
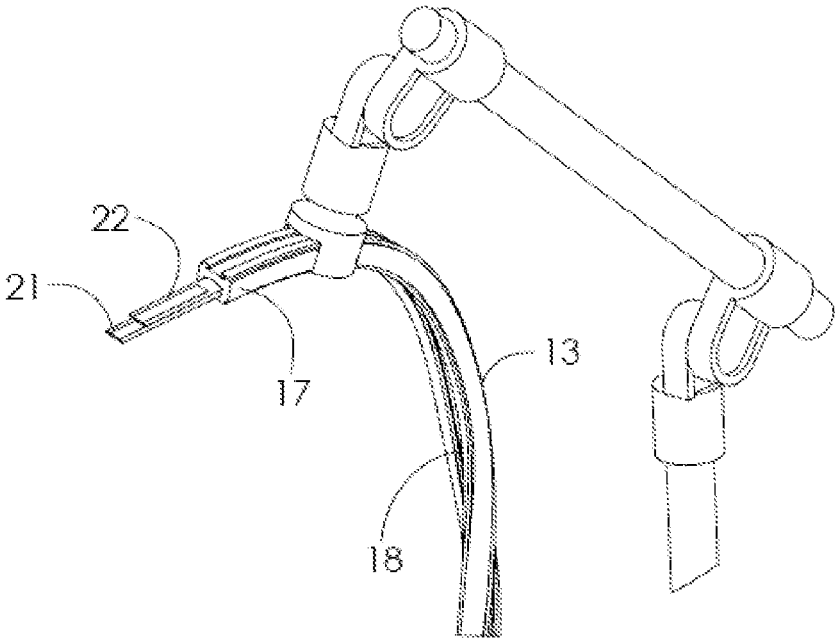
FIG. 8 is a partial view of the discharge end of the track body of FIG. 1, showing the primary tape and the secondary tape extending from the discharge end.

In another embodiment, one particularly suited for use with a secondary tape 22 having a removable release liner 24, the main track body 13 of the tape delivery assembly 10 comprises a liner retarding member 25 disposed on the interior wall 16 of the secondary channel 15. If disposed near the discharge end 17 of the track body 13, the release liner 24 will be removed and ejected from the end of the secondary channel 15. If the liner retarding member 25 is disposed at an interior point along secondary channel 15, an ejection window 26 is provided on the track body 13 that communicates with the secondary channel 15, as shown in FIG. 7. The liner retarding member 25 is a member of suitably high friction or tackiness, such as for example a ridge composed of a relatively soft polyethylene polymer. The release liner 24 of the secondary tape 22 is folded back upon itself at its leading end. As the secondary tape 22 is advanced within the secondary channel 15, the release liner 24 is frictionally restrained by the liner retarding member 25 such that it is pulled from the secondary tape 22 to expose the adhesive layer. The ejection window 26 is positioned such that the release liner 24 passes therethrough as it is removed.

Embodiments of the invention as described may be utilized at initial installation of a paper web turn-up system. Alternatively, the tape delivery assembly 10 as described herein may be retrofitted onto existing paper web turn-up systems.

It is understood that equivalents and substitutions for certain elements and structure set forth above may be obvious to those of ordinary skill in the art, and therefore the true scope and definition of the invention in its various embodiments is to be as set forth in the following claims.

We claim:

1. A paper web turn-up system turn-up tape delivery assembly adapted to deliver a primary tape and a secondary tape across a paper web and utilized to sever a paper web and transfer the paper web onto an empty spool, the turn-up tape delivery assembly comprising:

a track body, said track body comprising a primary channel adapted to receive a primary tape, a secondary channel adapted to receive a secondary tape, an elongated slot in communication with said primary channel and said secondary channel, and a discharge end;

wherein both said primary channel and said secondary channel are adapted to communicate with said discharge end of said track body such that the primary tape and the secondary tape are deliverable through said discharge end;

a primary tape dispenser assembly adapted to deliver the primary tape into said primary channel of said track body;

a secondary tape dispenser assembly adapted to deliver the secondary tape into said secondary channel of said track body;

wherein in the event of a misfeed of the primary tape through said primary channel of said track body or a malfunction of the primary tape dispenser assembly, the secondary tape is delivered by said secondary tape dispenser assembly through said secondary channel and said discharge end of said track body.

2. The turn-up tape delivery assembly of claim 1, wherein said primary channel and said secondary channel are disposed in parallel within said track body.

3. The turn-up tape delivery assembly of claim 2, further comprising a braking mechanism operable in conjunction with said primary channel and said secondary channel to retard both the primary tape and the secondary tape.

4. The turn-up tape delivery assembly of claim 3, wherein said braking mechanism comprises:

a primary brake foot member operated by a primary actuating mechanism, said primary brake foot member positioned to contact the primary tape within said primary channel;

a secondary brake foot member operated by a secondary actuating mechanism, said secondary brake foot member positioned to contact the secondary tape within said secondary channel; and a fixed brake pad member disposed between said primary channel and said secondary channel;

whereby actuation of said primary actuating mechanism forces the primary tape against said fixed brake pad member, thereby retarding travel of the primary tape, and whereby actuation of said secondary actuating mechanism forces the secondary tape against said fixed brake pad member, thereby retarding travel of the secondary tape.

5. The turn-up tape delivery assembly of claim 3, wherein said braking mechanism comprises:

a brake foot member operated by a brake actuating mechanism, said brake foot member positioned to advance into said primary channel to contact the primary tape or positioned to advance into said secondary channel to contact the secondary tape;

a movable brake pad member disposed between said primary channel and said secondary channel, and disposed between the primary tape and the secondary tape;

whereby actuation of said brake actuating mechanism advances said brake foot member into said primary channel and forces the primary tape against said movable brake pad member, forces said movable brake pad member against the secondary tape, and forces the secondary tape against a wall of said secondary channel, or advances said brake foot member into said secondary channel and forces the secondary tape against said movable brake pad member, forces said movable brake pad member against the primary tape, and forces the primary tape against a wall of said primary channel, thereby arresting travel of both the primary tape and the secondary tape.

6. The turn-up tape delivery assembly of claim 3, further comprising a liner retarding member disposed within said secondary channel;

whereby in conjunction with a secondary tape having a release liner, said liner retarding member removes the release liner from the secondary tape as the secondary tape is advanced past said liner retarding member.

7. The turn-up tape delivery assembly of claim 6, further comprising an ejection window disposed on said main track body;

whereby in conjunction with the secondary tape having the release liner, said liner retarding member removes the release liner from the secondary tape as the secondary tape is advanced past said liner retarding member, such that the release liner when removed is ejected through said ejection window.

8. The turn-up tape delivery assembly of claim 2, further comprising a liner retarding member disposed within said secondary channel;

whereby in conjunction with a secondary tape having a release liner, said liner retarding member removes the release liner from the secondary tape as the secondary tape is advanced past said liner retarding member.

9. The turn-up tape delivery assembly of claim 8, further comprising an ejection window disposed on said main track body;

whereby in conjunction with the secondary tape having the release liner, said liner retarding member removes the release liner from the secondary tape as the secondary tape is advanced past said liner retarding member, such that the release liner when removed is ejected through said ejection window.

10. The turn-up tape delivery assembly of claim 1, further comprising a braking mechanism operable in conjunction with said primary channel and said secondary channel to retard both the primary tape and the secondary tape, whereby upon activation of said braking mechanism said primary tape or said secondary tape is pulled through said slot of said track body.

11. The turn-up tape delivery assembly of claim 10, wherein said braking mechanism comprises:

a primary brake foot member operated by a primary actuating mechanism, said primary brake foot member positioned to contact the primary tape within said primary channel;

a secondary brake foot member operated by a secondary actuating mechanism, said secondary brake foot member positioned to contact the secondary tape within said secondary channel; and a fixed brake pad member disposed between said primary channel and said secondary channel;

whereby actuation of said primary actuating mechanism forces the primary tape against said fixed brake pad member, thereby retarding travel of the primary tape, and whereby actuation of said secondary actuating mechanism forces the secondary tape against said fixed brake pad member, thereby retarding travel of the secondary tape.

12. The turn-up tape delivery assembly of claim 10, wherein said braking mechanism comprises:

a brake foot member operated by a brake actuating mechanism, said brake foot member positioned to advance into said primary channel to contact the primary tape or positioned to advance into said secondary channel to contact the secondary tape;

a movable brake pad member disposed between said primary channel and said secondary channel, and disposed between the primary tape and the secondary tape;

whereby actuation of said brake actuating mechanism advances said brake foot member into said primary channel and forces the primary tape against said movable brake pad member, forces said movable brake pad member against the secondary tape, and forces the secondary tape against a wall of said secondary channel, or advances said brake foot member into said secondary channel and forces the secondary tape against said movable brake pad member, forces said movable brake pad member against the primary tape, and forces the primary tape against a wall of said primary channel, thereby arresting travel of both the primary tape and the secondary tape.

13. The turn-up tape delivery assembly of claim 10, further comprising a liner retarding member disposed within said secondary channel;

whereby in conjunction with a secondary tape having a release liner, said liner retarding member removes the release liner from the secondary tape as the secondary tape is advanced past said liner retarding member.

14. The turn-up tape delivery assembly of claim 13, further comprising an ejection window disposed on said main track body;

whereby in conjunction with the secondary tape having the release liner, said liner retarding member removes the release liner from the secondary tape as the secondary tape is advanced past said liner retarding member, such that the release liner when removed is ejected through said ejection window.

15. The turn-up tape delivery assembly of claim 1, wherein said secondary tape delivery assembly is manually operated.

16. The turn-up tape delivery assembly of claim 1, wherein said secondary tape delivery assembly is powered.

17. The turn-up tape delivery assembly of claim 1, further comprising a liner retarding member disposed within said secondary channel;

whereby in conjunction with a secondary tape having a release liner, said liner retarding member removes the release liner from the secondary tape as the secondary tape is advanced past said liner retarding member.

18. The turn-up tape delivery assembly of claim 17, further comprising an ejection window disposed on said track body;

whereby in conjunction with the secondary tape having the release liner, said liner retarding member removes the release liner from the secondary tape as the secondary tape is advanced past said liner retarding member, such that the release liner when removed is ejected through said ejection window.

19. A turn-up tape delivery assembly in combination with a paper web turn-up system, the turn-up tape delivery assembly adapted to deliver a primary tape and a secondary tape across a paper web utilized to sever a paper web and transfer the paper web onto an empty spool, the turn-up tape delivery assembly comprising:

a track body, said track body comprising a primary channel adapted to receive a primary tape, a secondary channel adapted to receive a secondary tape, an elongated slot in communication with said primary channel and said secondary channel, and a discharge end, wherein said primary channel and said secondary channel extend to said discharge end;

wherein both said primary channel and said secondary channel are adapted to communicate with said discharge end of said track body such that the primary tape and the secondary tape are deliverable through said discharge end;

a primary tape dispenser assembly adapted to deliver the primary tape into said primary channel of said track body;

a secondary tape dispenser assembly adapted to deliver the secondary tape into said secondary channel of said track body;

wherein in the event of a misfeed of the primary tape through said primary channel of said track body or a malfunction of the primary tape dispenser assembly, the secondary tape is delivered by said secondary tape dispenser assembly through said secondary channel and said discharge end of said track body.

20. A turn-up tape delivery assembly in combination with a paper web turn-up system, the turn-up tape delivery assembly adapted to deliver a primary tape and a secondary tape across a paper web and utilized to sever a paper web and transfer the paper web onto an empty spool, the turn-up tape delivery assembly comprising:

a track body, said track body comprising a primary channel adapted to receive a primary tape, a secondary channel adapted to receive a secondary tape, an elongated slot in communication with said primary channel and said secondary channel, and a discharge end, wherein said primary channel and said secondary channel extend to said discharge end;

wherein both said primary channel and said secondary channel are adapted to communicate with said discharge end of said track body such that the primary tape and the secondary tape are deliverable through said discharge end;

a primary tape dispenser assembly adapted to deliver the primary tape into said primary channel of said track body;

a secondary tape dispenser assembly adapted to deliver the secondary tape into said secondary channel of said track body;

wherein in the event of a misfeed of the primary tape through said primary channel of said track body or a malfunction of the primary tape dispenser assembly, the secondary tape is delivered by said secondary tape dispenser assembly through said secondary channel and said discharge end of said track body;

and further comprising a braking mechanism operable in conjunction with said primary channel and said secondary channel to retard both the primary tape and the secondary tape, whereby upon activation of said braking mechanism said primary tape or said secondary tape is pulled through said slot of said track body.

* * * * *